US005815883A

United States Patent [19]

Stein et al.

[11] Patent Number: 5,815,883

[45] Date of Patent: Oct. 6, 1998

[54] VACUUM CLEANER AND A HANDLE FOR SUCTION LINES THEREOF

[76] Inventors: Klaus Stein; Heinz Kaulig, both of Wülfrather Str. 47-49, D-42553 Velbert, Germany

[21] Appl. No.: 463,495

[22] Filed: Jun. 5, 1995

[30] Foreign Application Priority Data

Jun. 3, 1994 [DE] Germany ..... 44 19 401.3

[51] Int. Cl.[6] ..... A47L 9/32

[52] U.S. Cl. ..... 15/327.1; 15/331; 15/377; 15/410

[58] Field of Search ..... 15/410, 331, 334, 15/335, 377, 327.1

[56] References Cited

U.S. PATENT DOCUMENTS

| | | | |
|---|---|---|---|
| 4,915,640 | 4/1990 | Hayden | 15/410 X |
| 4,955,106 | 9/1990 | Stein et al. | 15/410 X |
| 4,980,945 | 1/1991 | Bewley | 15/410 X |
| 5,054,157 | 10/1991 | Werner et al. | 15/377 X |
| 5,343,590 | 9/1994 | Radabaugh | 15/410 X |

FOREIGN PATENT DOCUMENTS

| | | | |
|---|---|---|---|
| 370981 | 5/1990 | European Pat. Off. | 15/410 |
| 48308 | 8/1983 | Germany | 15/410 |
| 161580 | 6/1993 | Japan | 15/410 |

*Primary Examiner*—Chris K. Moore
*Attorney, Agent, or Firm*—Nils H. Ljungman and Associates

[57] ABSTRACT

The problem with suction lines on vacuum cleaners is that the connected vacuum hose must be lifted during when the suction pipe is rotated. To eliminate this problem, the invention teaches that an elbow is interposed between the suction pipe and the suction hose which is mounted by means of a rotating knuckle, as a result of which the suction hose can be adjusted as required, and the suction pipe can be ergonomically manipulated by means of an angled gripping area of the handle.

20 Claims, 4 Drawing Sheets

VACUUM CLEANER AND A HANDLE FOR SUCTION LINES THEREOF

BACKGROUND OF THE INVENTION

1. Field of the Invention

The present invention generally relates to a handle for manipulating suction lines for equipment which uses a vacuum, such as vacuum cleaners. Such suction lines generally include suction pipes and suction hoses. When used in combination, a handle can be located in the transitional region between the suction pipe and the suction hose.

2. Background Information

Such devices are known and include many different handles of this type. However, with such known devices, the problem addressed by the invention is solved only to a limited extent, because easy manipulation of the suction pipe is possible only with suction pipes which have rather large diameters. Such known devices also include functional and switching elements which are located in these handles.

It has been found, however, that the handles of such known devices do not allow ergonomic manipulation when the suction pipe must be rotated during the vacuuming process, e.g. when working in crevices, tight corners or similar areas, because the hose must be rotated and lifted, which makes it more difficult to manipulate.

OBJECT OF THE INVENTION

The object of the present invention is to improve the systems of such known devices by making possible ergonomic manipulation, and to essentially eliminate, in a simple manner, the need to lift the suction hose when the suction pipe is rotated.

SUMMARY OF THE INVENTION

The present invention teaches that this object can be accomplished if, on the inlet side, the suction pipe has a handle which can have an angled gripping area, and can be angled in the range between 25 and 50 degrees toward the axis of the suction pipe, and if between the suction pipe and the suction hose there is an elbow which is connected to the suction pipe by means of a turning knuckle or hinge which lies in the axis of the suction pipe. The elbow can preferably hold the suction hose on the discharge side, and the elbow can have a portion bent at an angle which corresponds approximately to the angle of the bend of the gripping area of the handle.

The result is an essentially easy manipulation, whereby the axis of the suction can continue approximately into the axis of the user's forearm, and the user's wrist can be held relatively rigid. Thus a low-bend transition between the suction hose and the unit can also be essentially guaranteed. As a result, essentially no additional effort is required to orient the hose in the desired direction. When the unit is rotated, the suction hose essentially need not be lifted, since its position can be maintained by means of the rotating elbow.

In one simple configuration of the present invention, there can be an intermediate element, which intermediate element can act as a connection between the vacuum pipe and the elbow. The handle can also be located on the intermediate element.

In one configuration of the present invention, there can be a difference of not more than essentially 15 degrees between the angle of the bent portions of the handle and the angle of the elbow.

The present invention also teaches that an essentially easy rotation can be achieved if the connection area between the elbow and the suction hose is located in front of, or in the gripping area of the handle.

For an essentially easy adjustment without rotation of the suction hose, the present invention teaches that the connection for the suction hose can be formed on the elbow by means of a rotating knuckle or hinge.

It should be understood that when the word "invention" is used in this application, the word "invention" includes "inventions," that is, the plural of "invention." By stating "invention," applicant does not in any way admit that the present application does not include more than one patentably and non-obviously distinct invention, and maintains the possibility that this application may include more than one patentably and non-obviously distinct invention. The applicant hereby asserts that the disclosure of this application may include more than one invention, and, in the event that there is more than one invention, that these inventions may be patentable and non-obvious, one with respect to the other.

One aspect of the present invention resides broadly in a vacuum cleaner for movement along a surface, which vacuum cleaner comprises: a housing comprising a motor; a suction fan disposed for being driven by the motor; the motor and the suction fan comprising an apparatus for producing suction; a suction inlet disposed adjacent the apparatus for producing suction; a hose having a first end being connected to the suction inlet; the hose having a second end; a handle being disposed adjacent and operatively connected to the second end of the hose; the handle having a first end and a second end; the first end and the second end being disposed a substantial distance from one another; the handle means defining a first longitudinal axis; the first longitudinal axis being disposed to extend from substantially the first end and to generally the second end; the second end of the handle means comprising an angled portion; the angled portion of the handle having a second axis; the second longitudinal axis being disposed at a first angle with respect to the first longitudinal axis; said first angle being disposed at a substantial angle with respect to the first longitudinal axis; the first end of the handle comprising an intake device; an apparatus for sucking debris from a surface being connected to the intake device; an apparatus for connecting the second end of the hose adjacent the handle; the apparatus for connecting being disposed substantially adjacent the handle; the apparatus for connecting comprising a portion for connecting with the second end of the suction hose; the connecting portion defining a third longitudinal axis; the third longitudinal axis being disposed at a second angle with respect to the first longitudinal axis; the second angle being substantially equivalent to the first angle.

Another aspect of the present invention resides broadly in a handle for an attachment to a vacuum cleaner, which handle comprises: a first end and a second end; a central portion disposed between the first and second ends; the first end and the second end being disposed a substantial distance from one another; the handle means defining a first longitudinal axis; the first longitudinal axis extending from substantially the first end and to generally the second end; second end of the handle comprising an angled portion; the angled portion of the handle having a second longitudinal axis; the second longitudinal axis being disposed at a first angle with respect to the first longitudinal axis; the first angle being disposed at a substantial angle with respect to the first longitudinal axis; the first end of the handle comprising an intake apparatus; the intake apparatus comprising an apparatus for attaching to an attachment for sucking matter from a surface; the central portion of the handle comprising a connection device for connecting the end of the suction hose to the vacuum cleaner; the connection device for being disposed substantially adjacent the handle; the connection device comprising a portion; the connection portion having a third longitudinal axis; the third longitudinal axis being disposed at a second angle with respect to the first longitudinal axis; the second angle being substantially equivalent to the first angle.

Yet another aspect of the present invention resides broadly in a method of making and operating a vacuum cleaner, which vacuum cleaner comprises: a housing comprising a motor and a suction fan; the suction fan being disposed for being driven by the motor; the motor and the suction fan having a device for producing suction; a suction inlet disposed adjacent the device for producing suction; a suction hose having a first end connected to the suction inlet and a second end opposite the first end; a handle disposed adjacent and operatively connected to the second end of the suction hose; the handle having a first end and a second end; the first end and the second end being disposed a substantial distance from one another and the handle defining a first longitudinal axis being disposed to extend from substantially the first end and to generally the second end; the second end of the handle comprising an angled portion for being held in a hand; the angled portion of the handle defining a second longitudinal axis which is disposed at a first angle with respect to the first longitudinal axis; the first angle being disposed at a substantial angle with respect to the first longitudinal axis; the first end of the handle comprising an intake device for sucking debris from a surface; the apparatus for sucking debris from a surface being connected to the intake device; an apparatus for connecting the second end of the hose to handle; the apparatus for connecting being disposed substantially adjacent the handle; the apparatus for connecting comprising a portion for connecting with the second end of the suction hose; the connecting portion defining a third longitudinal axis; the third longitudinal axis being disposed at a second angle with respect to the first longitudinal axis; and the second angle being substantially equivalent to the first angle; the method of making comprising the steps of: providing the housing; providing the motor; providing the suction fan; providing the suction inlet; providing the suction hose; providing the handle comprising the first longitudinal axis between the first and second ends; providing the handle with the angled portion, which angled portion has the second longitudinal axis; providing the intake device; providing the apparatus for sucking debris from a surface; providing the apparatus for connecting the second end of the suction hose to the handle; providing the apparatus for connecting with the connecting portion, which connecting portion has the third longitudinal axis; the method of making further comprising the steps of: disposing the motor and suction fan in the housing; connecting the motor and suction fan to produce suction; connecting the suction inlet in the housing; operatively connecting the motor and suction fan to the suction inlet; connecting an end of the suction hose with the suction inlet; connecting an opposite end of the suction hose with the handle; configuring the handle to include the angled portion; disposing the second longitudinal axis at a first angle with respect to the first longitudinal axis; disposing the first angle at a substantial angle with respect to the first longitudinal axis; disposing the intake device on the first end of the handle; connecting the apparatus for sucking debris to the intake device; disposing the apparatus for connecting adjacent the handle; disposing the connecting portion on the apparatus for connecting; disposing the second end of the suction hose to the connecting portion; disposing the third longitudinal axis at a second angle with respect to the first longitudinal axis; disposing the second angle to be substantially equivalent to the first angle; the method of operating comprising the steps of: moving the handle in a back and forth motion along a surface thereby permitting the suction hose to move about the second angle with respect to the first longitudinal axis.

BRIEF DESCRIPTION OF THE DRAWINGS

The embodiments of the present invention are described in greater detail below with reference to the accompanying drawings, in which.

DESCRIPTION OF THE PREFERRED EMBODIMENT

Figure 1:
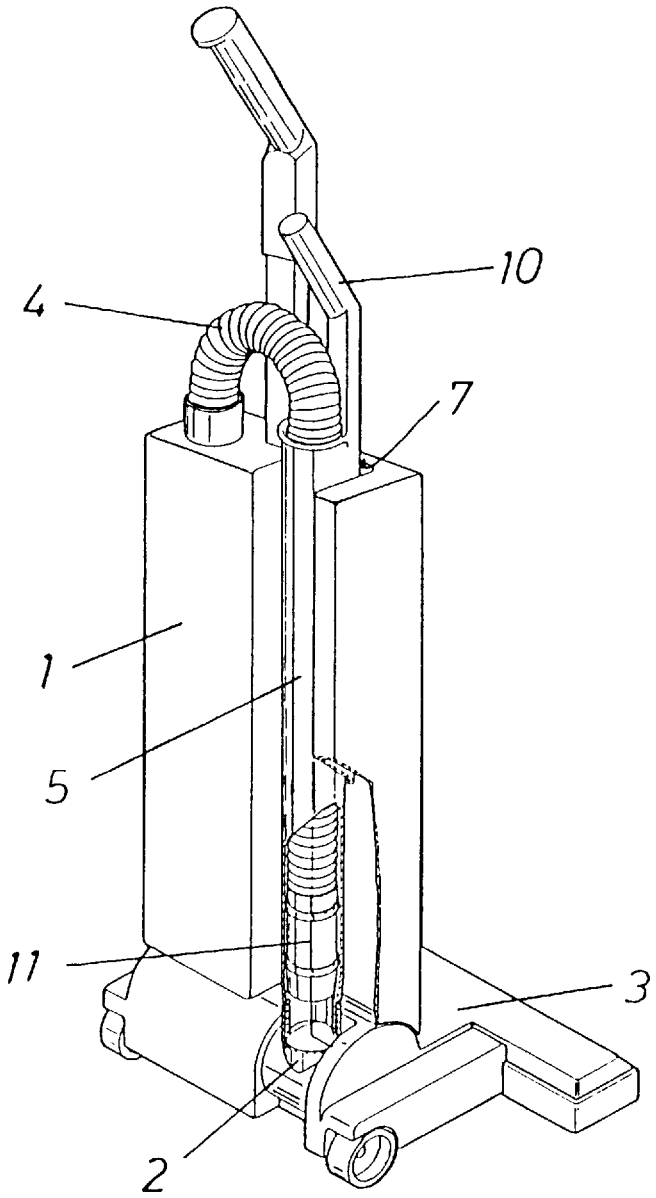
FIG. 1 shows an overall view of an upright brush-type vacuum cleaner for floor cleaning operations.
Figure 1A:
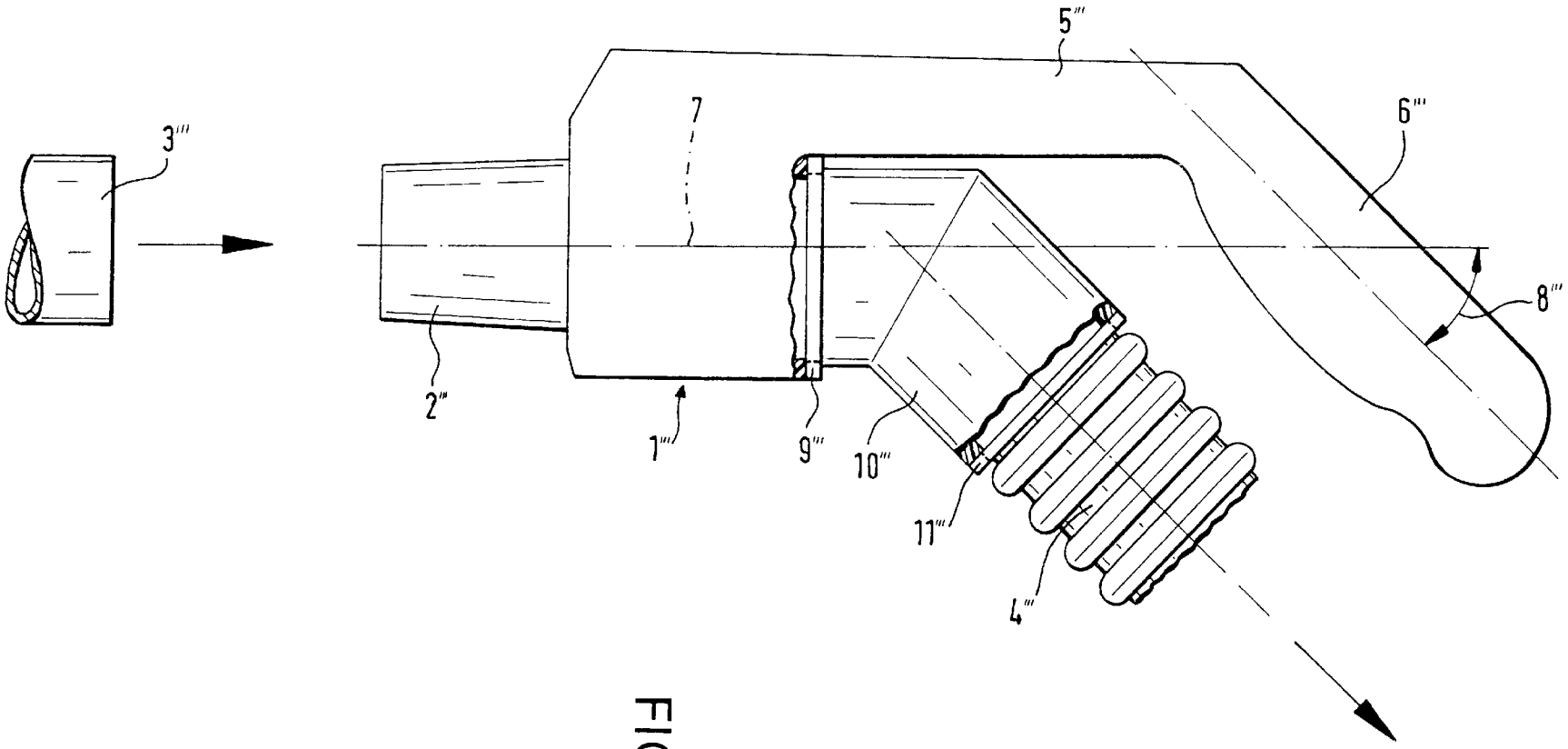
FIG. 1*a* shows a detailed view of an intermediate element used as a connection between the suction pipe and the elbow.

As shown in FIG. 1*a,* an intermediate element 1''', on its air inlet side, can have a socket 2''', which socket 2''' can hold a vacuum pipe 3'''. The intermediate element 1''' can act as a transition for the connection of a suction hose 4''' located on the discharge side. The intermediate element 1''' can also have a handle 5''' which, in its gripping area 6''', can be angled at an angle 8''' with respect to an axis 7''' of the vacuum pipe. This angle 8''' can be between about 25 and about 50 degrees, as a function of the intended use.

In accordance with a preferred embodiment of the present invention, therefore, the intermediate element 1''' can provide a connection between the components such as the socket 2''', the suction pipe 3''', and the suction hose 4'''. Further, the intermediate element 1''' can connect the handle 5''' with the socket 2''', suction pipe 3''', and suction hose 4'''. Because of the angle 8''' of the gripping area 6''', the handle 5''' can facilitate operation by providing an angle corresponding between the user's arm and the components of the vacuum cleaner.

In an embodiment of the present invention, the socket 2''' and the suction pipe 3''' may together form essentially one solid component of the present invention. Or, alternatively, the socket 2''', for example, may be designed as a male portion wherein suction pipe 3''', which can be designed as a female portion, can be inserted thereon to permit attachment to the handle 5'''.

On the air outlet side of the intermediate element 1''', by means of a rotating knuckle 9''', an elbow 10''' can be inserted. On its other end, the elbow 10''' can hold the vacuum hose 4''' by means of a rotating knuckle 11'''. The present invention teaches that the angle at which the elbow 10''' can be bent does not essentially differ by more than about 15 degrees from the angle at which the bent portion of the gripping area 6''' of the handle 5''' can be bent.

In accordance with a preferred embodiment of the present invention, as shown in FIG. 10*a*, the elbow 10''' can preferably be located at an angle which is within about 15 degrees of the angle 8''' of the gripping area 6'''. Such correspondence of angles between gripping area 6''' and elbow 10''' essentially makes possible a direct correspondence of movement and positioning between the handle 5''' and elbow 10'''. Thereby, the suction hose 4''', which can be rotatably connected to elbow 10''' by rotating knuckle 11''', can rotatably self-adjust. As a result, there is essentially no need to lift and readjust the suction hose 4''' during operation of the vacuum cleaner.

When the attached suction pipe 3''' is rotated during operation, by means of the gripping area 6''' of the handle 5''', on one hand, easy manipulation is essentially possible as a result of the angular orientation with respect to the vacuum pipe axis 7'''. On the other hand, the connected vacuum hose 4''' can be rotated by means of the elbow and the rotating knuckle 9''', 11''' into a position where it can offer low resistance, so that there is essentially no need to lift the vacuum hose 4''' as the vacuum hose 4''' is rotated.

In accordance with an alternative embodiment of the present invention, the hose 4''' can be designed as a separate component which can be attached and detached as needed.

It is also essentially possible, without the intermediate piece 1''', to rotationally attach the system comprising the handle 5''' and the elbow 10''' directly to the suction pipe 3'''.

In an alternative embodiment of the present invention, the elbow 10''' can be designed as a flexible element whereby the attached hose 4''' can essentially be easily adjusted as the the user moves and positions the handle 5''' during operation of the vacuum cleaner.

In an embodiment of the present invention, the intermediate element 1''', in the area where the rotating knuckle 9''' can be located, can preferably comprise an angled area with respect to the axis of vacuum pipe 3'''. Instead of the elbow 10''' there can preferably be a straight portion, rather than a bent portion, which straight portion can be attached to the angled area of the intermediate element 1''', by means of the rotating knuckle 9'''. The angled area of the intermediate element 1''' can thus permit the straightened portion of the elbow 10''' to be located at an angle within 15 degrees of the angle of the gripping area 6'''.

In accordance with a preferred embodiment of the present invention, the handle 5''' and the related components, as shown in FIG. 1*a,* may be used on various types of vacuum cleaners including upright and canister vacuum cleaners, for example. In the case of a canister vacuum cleaner, the suction hose 4''' can be connected at one end to the canister. The suction hose 4''' can then be connected at the opposite end to the handle 5''' adjacent the intermediate element 1'''. The attachments of the vacuum cleaner can then be attached with the socket 3''' for use during operation.

The present invention, as shown in FIG. 1*a,* can be utilized in a vacuum cleaner such as described hereinbelow with reference to FIGS. 1, 2, and 3. The upright brush-type vacuum cleaner illustrated in FIGS. 1, 2, and 3 comprises a housing 1 with a handle which is designed as the filter cassette for a filter bag. In the lower portion there is a brush set 3 which is connected via a nozzle linkage 2 with a suction nozzle and can be rolled along the floor by means of corresponding wheels.

Connected to the upper portion of the housing 1 is the first end of a hand-held vacuum hose 4, which is supplied with working air by means of the suction nozzle. The hand-held vacuum hose 4 is detachably coupled with a hand-held vacuum tube 5. As best seen in FIG. 2, the end of the hand-held vacuum hose 4 with a vacuum mouthpiece 11 as a second end thereof connected via a detachable catch 6 with the corresponding end of the hand-held vacuum tube 5. As seen in FIG. 1, the hand-held vacuum tube 5 can be inserted in a recess 7 in the housing and is thereby connected at the lower end thereof with the nozzle linkage 2 leading to the vacuum nozzle. The hand-held vacuum tube 5 is thereby used as a storage site for the telescoping hand-held vacuum hose 4, located in the hand-held vacuum tube 5. The external portion of the hand-held vacuum hose 4 is thereby significantly shortened for normal floor vacuuming, which reduces vacuum losses and does not interfere with the operation of the machine. For floor vacuuming operation, in this position, a substantial portion of the hand-held vacuum hose 4 is disposed within the tube 5 and acts as an ascending line for the working air laden with dirt.

Figure 2:
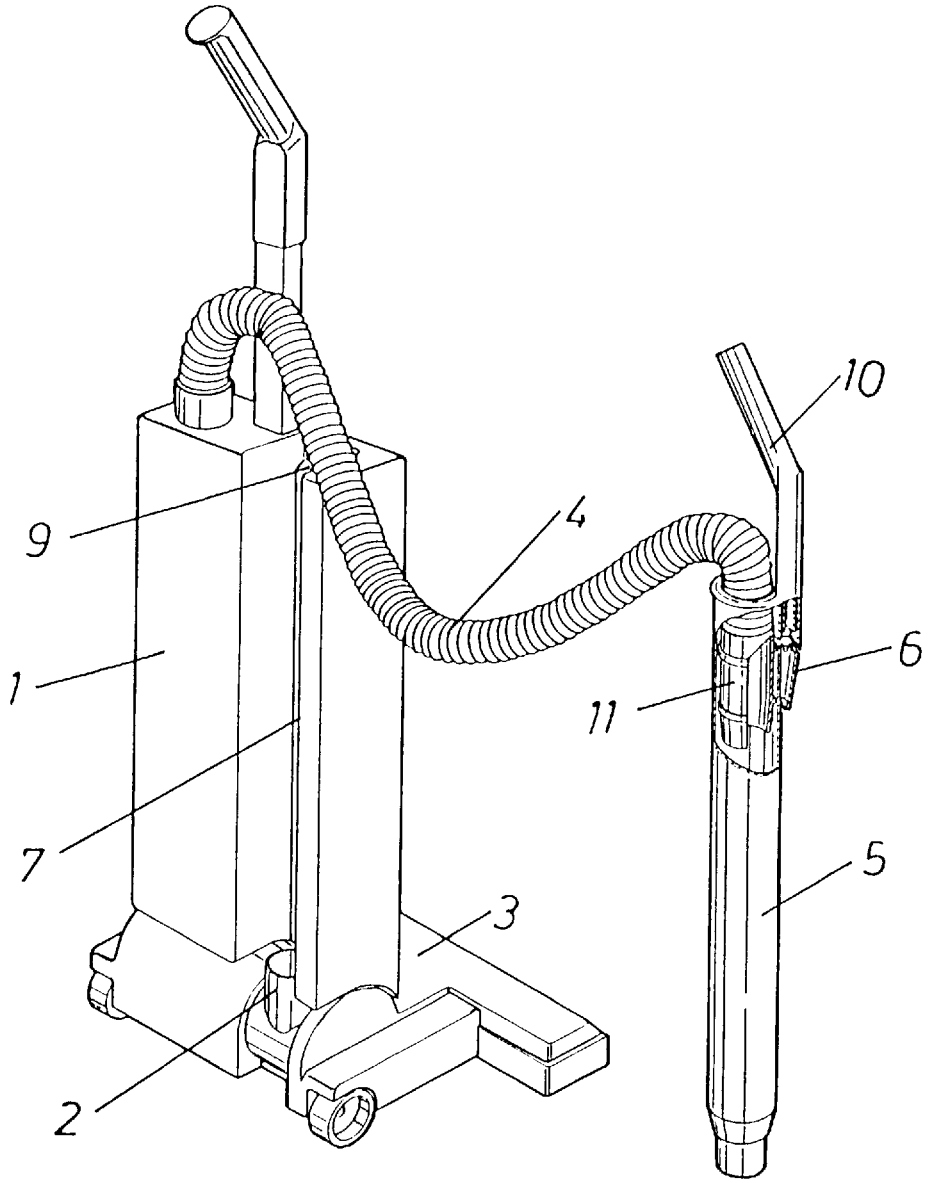
FIG. 2 shows a brush-type vacuum cleaner for auxiliary vacuuming operations with the hand-held vacuum tube.
Figure 3:
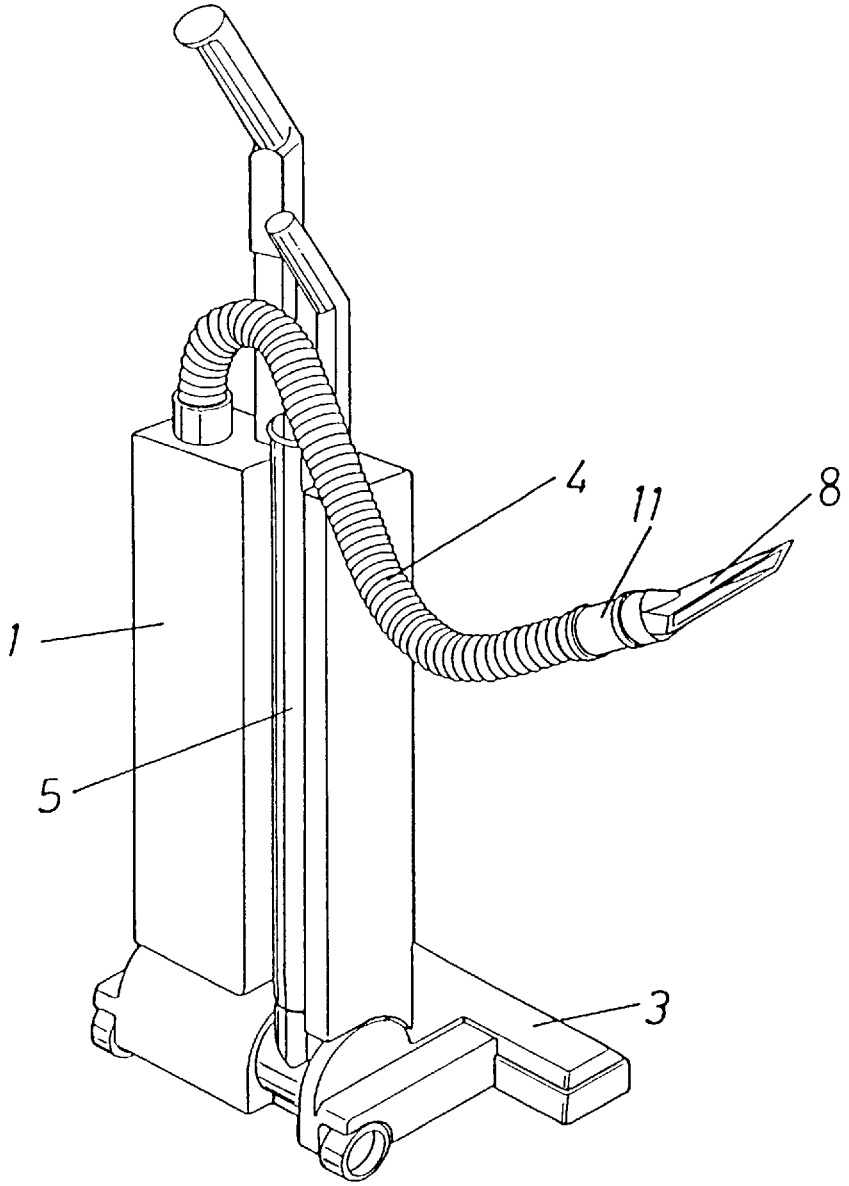
FIG. 3 shows an upright brush vacuum cleaner for auxiliary vacuuming operations with a hand-held vacuum hose, which is separated from the vacuum tube, with a working nozzle installed thereon.

On the other hand, in the extended position of the hand-held vacuum hose 4 illustrated in FIG. 2, auxiliary vacuuming operations can be conducted over a large radius of action by means of the resulting extension of the hose 4 and the hand-held vacuum tube 5 which serves as a further extension. When the hand-held vacuum hose 4 is pulled out, it is fastened with its vacuum mouth-piece 11 on the end of the hand-held vacuum tube 5 by means of the catch 6 to prevent the hand-held vacuum tube 4, with its vacuum mouth-piece 11, from being sucked back in during operation. The catch 6 may be a pivoted member which is normally biased inwardly to extend into the interior of the tube 5 through an opening in the side wall thereof. The inward end of the catch can be notched or grooved to align with and engage raised portions on the mouth-piece 11 to prevent its insertion into or extraction from the tube 5.

For special auxiliary vacuuming operations, the vacuum mouth-piece 11 of the hand-held vacuum hose 4 is removed from the hand-held vacuum tube 5 by moving the catch 6 against the biasing to release the mouth-piece 11. As shown in FIG. 3, the vacuum tube 5 is replaced by appropriate slip-on operating nozzles 8.

With the mouth-piece inserted in the tube 5, the catch 6, when the hand-held vacuum tube 5 is inserted in the housing 1, is unlocked by an edge 9, and thus the manual vacuum hose 4 can be removed. The edge 9 can include a camming surface which acts on the lower end of the catch 6 to cause it to move outwardly against the biasing. To improve handling, the hand-held vacuum tubes is extended by means of a handle 10.

After the auxiliary vacuuming operations have been completed, the vacuum mouth-piece 11 is inserted or screwed back into the hand-held vacuum tube 5, which is located in the recess 7 in the housing 1. Again, the edge 9 prevents the catch from engaging and entrapping the mouth-piece 11 at the outer end of the tube 5. When the fan motor is running, the hand-held vacuum hose 4 is automatically retracted by the underpressure in the hand-held vacuum tube 5, until the vacuum mouth-piece 11 assumes the position indicated in FIG. 1.

One feature of the invention resides broadly in the handle for the manipulation of vacuum lines for vacuum equipment, such as vacuum cleaners, in the form of suction pipes and suction hoses, whereby a handle is located in the transitional area between the suction pipe and the suction hose, characterized by the fact that the inlet-side suction pipe 3''' has a handle 5''' which has an angled gripping area 6''', and is bent in a range between 25 and 50 degrees toward the suction pipe axis 7''', and interposed between the suction pipe 3''' and the suction hose 4''' there is an elbow 10''' which is connected with the suction pipe 3''' by means of a rotating knuckle 9''' which lies in the suction pipe axis 7''', which elbow 10''' holds the suction hose 4''' on its outlet side, and the elbow is bent at an angle which approximately equals the angle of the bend of the gripping area 6''' of the handle 5'''.

Another feature of the invention resides broadly in the handle characterized by the fact that there is an intermediate element 1''' as a connection between the suction pipe 3''' and the elbow 10''' which intermediate element has the handle 5'''.

Yet another feature of the invention resides broadly in the handle characterized by the fact that there is a difference between the angles of the bends of the gripping area 6''' and of the elbow 10''' of not more than 15 degrees.

Still another feature of the invention resides broadly in the handle characterized by the fact that the connecting area between the elbow 10''' and the suction hose 4''' is located in front of or in the gripping area 6'''.

A further feature of the invention resides broadly in the handle characterized by the fact that the connection for the suction hose 4''' on the elbow 10''' is formed by a rotating knuckle 11'''.

The components disclosed in the various publications, disclosed or incorporated by reference herein, may be used in the embodiments of the present invention, as well as, equivalents thereof.

Examples of vacuum cleaners and related devices may be found in now allowed U.S. patent application Ser. No. 07/466,038 entitled "A Floor Cleaning Machine" and U.S. Pat. No. 4,418,342 entitled "Method of and a Circuit for Indicating the Optimum Adjustment of the Working Position of a Brush Roller in an Electrically Operated Floor Cleaning Appliance"; U.S. Pat. No. 4,910,824 entitled "Floor Polisher"; U.S. Pat. No. 4,679,271 entitled "Automatic Tool Force Compensator for a Surface Maintenance Machine"; U.S. Pat. No. 4,955,106 entitled "Upright Vacuum Cleaner"; U.S. Pat. No. 4,699,641 entitled "Support Tray for Disposable Filter Bag", U.S. Pat. No. 4,262,384 entitled "Vacuum Cleaner Bag Assembly"; U.S. Pat. No. 4,452,618 entitled "Suction Cleaners With a Bag Transfer Arrangement"; and U.S. Pat. No. 4,705,547 entitled "Dirt Drawer Latch for Vacuum Cleaner"' and U.S. Pat. No. 5,028,245 entitled "Vacuum Cleaner Including Filter Bag Mounting Apparatus".

Additional examples of vacuum cleaners and related devices may be or are disclosed in the following U.S. Patents: U.S. Pat. No. 4,850,077 entitled "Double Brush-roll Vacuum Cleaner" to Domenico; U.S. Pat. No. 5,309,601 entitled "Vacuum Cleaner with Improved Assembly" to White Consolidated Industries, Inc.; and U.S. Pat. No. 5,187,832 entitled "Convertible Self-propelled Vacuum Cleaner" to Meyer, Lackner, and Matuschek.

Some examples of devices which may be utilized in accordance with the present invention may be or are disclosed in the following U.S. Patents: U.S. Pat. No. 4,941,689 entitled "Coupling Device for Vacuum Cleaner" to Electrolux; U.S. Pat. No. 5,039,133 entitled "Suction Nozzle Coupling having Rotatably Mounted therein a Connector for a Suction Hose" to Dupro; U.S. Pat. No. 5,109,568 entitled "Handle Assembly for a Vacuum System Cleaning Tool" to Rexair; U.S. Pat. No. 4,694,529 entitled "Suction Device" to Choiniere; and U.S. Pat. No. 5,331,716 entitled "Vacuum Cleaner with Extendable Hose and Brush Disengagement" to Black & Decker.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 19 401.3, filed on Jun. 3, 1994, and DE-OS P 44 19 401.3 and DE-PS P 44 19 401.3, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A handle assembly for an attachment to a vacuum cleaner, said handle assembly comprising:

an intake air portion for receiving air;

said intake air portion defining an intake air axis along which intake air flows;

an exhaust air portion for expelling air;

said exhaust air portion comprising a substantially bent elbow with a first part and a second part;

a rotating knuckle having a rotational axis;

said rotational axis being substantially parallelly aligned with said intake air axis;

said rotating knuckle being connected to said first part of said elbow;

said rotating knuckle being disposed between said first part of said elbow and said intake air portion;

said second part of said elbow defining an exhaust air axis along which exhaust air flows;

said exhaust air axis being disposed at a first angle with respect to said intake air axis;

a handle connected with said intake air portion;

said handle having a substantial bend to form an angled portion for being gripped by the hand of a user;

said angled portion having a longitudinal axis; and said longitudinal axis of said angled portion being disposed at a second angle with respect to said intake air axis.

2. The handle assembly according to claim 1, wherein said handle assembly comprises:

an intermediate element disposed between said rotating knuckle and said intake air portion;

said handle is connected with said intermediate element; and said first angle and said second angle being substantially similar to one another.

3. The handle assembly according to claim 2, wherein said first angle and said second angle are within 15 degrees of one another.

4. The handle assembly according to claim 3, wherein said intermediate element connects said rotating knuckle and said intake air portion.

5. The handle assembly according to claim 4, wherein said second angle of said longitudinal axis of said angled portion of said handle is between about 25 degrees and about 50 degrees.

6. The handle assembly according to claim 4, wherein said longitudinal axis of said angled portion of said handle is disposed adjacent said exhaust air axis.

7. The handle assembly according to claim 6, wherein:

said handle comprises a central portion disposed between said intermediate element and said angled portion; and said central portion has a longitudinal axis substantially parallel to said air intake axis.

8. The handle assembly according to claim 7, wherein said handle assembly further comprises:

a second rotating knuckle;

said second rotating knuckle being disposed on said second part of said elbow; and said second rotating knuckle rotatably attaching said air exhaust portion to a suction hose of the vacuum cleaner.

9. The handle assembly according to claim 8, wherein said air intake portion comprises vacuum pipe means.

10. The handle assembly according to claim 9, wherein said vacuum pipe means comprises one of:

a suction pipe; and a suction pipe and a conical socket connected to one another;

said angled portion of said handle comprises means for being gripped;

said means for being gripped being configured for providing an ergonomic fit within the user's hand during operation of the vacuum cleaner;

said means for being gripped has a first side and a second side;

said first side faces toward said elbow; and said second side faces away from said elbow.

11. A vacuum cleaner for movement along a surface, said vacuum cleaner comprising:

a housing;

a motor;

said motor being disposed in said housing;

a suction fan;

said suction fan being disposed for being driven by said motor;

said motor and said suction fan together comprising means for producing suction;

a suction inlet disposed adjacent said means for producing suction;

a suction hose having a first end connected to said suction inlet and a second end opposite said first end;

a handle assembly disposed adjacent to said second end of said suction hose and being operatively connected to said second end of said suction hose;

said handle assembly comprising:

an intake air portion for receiving air;

said intake air portion defining an intake air axis along which intake air flows;

an exhaust air portion for expelling air;

said exhaust air portion comprising a substantially bent elbow with a first part and a second part;

a rotating knuckle having a rotational axis;

said rotational axis being substantially parallelly aligned with said intake air axis;

said rotating knuckle being connected to said first part of said elbow;

said rotating knuckle being disposed between said first part of said elbow and said intake air portion;

said second part of said elbow defining an exhaust air axis along which exhaust air flows;

said exhaust air axis being disposed at a first angle with respect to said intake air axis;

a handle connected with said intake air portion;

said handle having a substantial bend to form an angled portion for being gripped by the hand of a user;

said angled portion having a longitudinal axis; and said longitudinal axis of said angled portion being disposed at a second angle with respect to said intake air axis.

12. The vacuum cleaner according to claim 11, wherein said handle assembly comprises:

an intermediate element disposed between said rotating knuckle and said intake air portion;

said handle is connected with said intermediate element; and said first angle and said second angle are substantially similar to one another.

13. The vacuum cleaner according to claim 12, wherein both said second longitudinal axis of said angled portion of said handle and said exhaust air axis are disposed at angles within 15 degrees with respect to one another.

14. The vacuum cleaner according to claim 13, wherein said intermediate element connects said rotating knuckle and said intake air portion.

15. The vacuum cleaner according to claim 14, wherein said second angle of said longitudinal axis of said angled portion of said handle is between about 25 and about 50 degrees.

16. The vacuum cleaner according to claim 15, wherein said longitudinal axis of said angled portion of said handle is disposed adjacent said exhaust air axis.

17. The vacuum cleaner according to claim 16, wherein:

said handle comprises a central portion disposed between said intermediate element and said angled portion; and said central portion has a longitudinal axis substantially parallel to said air intake axis.

18. The vacuum cleaner according to claim 17, wherein said vacuum cleaner further comprises:

a second rotating knuckle;

said second rotating knuckle being disposed on said second part of said elbow; and said second rotating knuckle rotatably attaching said air exhaust, portion to said suction hose.

19. The vacuum cleaner according to claim 18, wherein said air intake portion comprises vacuum pipe means.

20. The vacuum cleaner according to claim 19, wherein said vacuum pipe means comprises one of:

a suction pipe; and a suction pipe and a conical socket connected to another;

said angled portion of said handle comprises means for being gripped;

said means for being gripped being configured for providing an ergonomic fit within the user's hand during operation of said vacuum cleaner;

said means for being gripped has a first side and a second side;

said first side faces toward said elbow; and said second side faces away from said elbow.

* * * * *

UNITED STATES PATENT AND TRADEMARK OFFICE

CERTIFICATE OF CORRECTION

PATENT NO. : 5,815,883

DATED : October 6, 1998

INVENTOR(S) : Klaus STEIN and Heinz KAULIG

It is certified that error appears in the above-identified patent and that said Letters Patent is hereby corrected as shown below:

In column 4, line 66, after 'FIG.', delete "10a," and insert --1a,--.

In column 6, line 43, after 'vacuum', delete "tubes" and insert --tube 5--.

In column 10, line 62, Claim 20, after 'to' insert --one--.

Signed and Sealed this

Twenty-third Day of February, 1999

*Attest:*

Q. TODD DICKINSON

*Attesting Officer*

*Acting Commissioner of Patents and Trademarks*